United States Patent [19]

Markham et al.

[11] 4,435,249

[45] Mar. 6, 1984

[54] PROCESS FOR THE OXYGEN DELIGNIFICATION OF PULP MILL REJECTS

[75] Inventors: Larry D. Markham, Pierrefonds, Canada; Andrew C. Martin, Middletown, Ohio; Edward F. Elton, Bethlehem; Vincent L. Magnotta, Coopersburg, both of Pa.; Scott A. Wallick, Seattle, Wash.

[73] Assignees: The Black Clawson Co., Middletown, Ohio; Air Products & Chemicals, Inc., Allentown, Pa.

[21] Appl. No.: 325,084

[22] Filed: Nov. 25, 1981

Related U.S. Application Data

[63] Continuation of Ser. No. 72,796, Sep. 5, 1979, abandoned.

[51] Int. Cl.[3] ..... D21B 1/04; D21C 9/10; D21D 5/02

[52] U.S. Cl. ..... 162/24; 162/25; 162/55; 162/65

[58] Field of Search ..... 162/24, 25, 55, 56, 162/65, 26, 149; 209/211

[56] References Cited

U.S. PATENT DOCUMENTS

| | | | |
|---|---|---|---|
| 3,096,275 | 7/1963 | Tomlinson | 209/211 |
| 3,313,677 | 4/1967 | Carr | 162/19 |
| 3,367,495 | 2/1968 | Lea et al. | 162/55 |
| 3,393,121 | 7/1968 | Lea et al. | 162/25 |
| 3,754,417 | 8/1973 | Jamieson | 162/65 |
| 3,830,688 | 8/1974 | Mannbro | 162/65 |
| 4,198,266 | 4/1980 | Kirk et al. | 162/65 |
| 4,220,498 | 9/1980 | Prough | 162/65 |
| 4,230,524 | 10/1980 | Hasvold | 162/65 |

FOREIGN PATENT DOCUMENTS

| | | | |
|---|---|---|---|
| 2818660 | 11/1978 | Fed. Rep. of Germany | 162/65 |

OTHER PUBLICATIONS

Klepp et al., "Oxygen/alkali Delignification at Kamyr Digester Blowline Consistency" TAPPI, Nov. 1976, vol. 59, No. 11 (77).

Hasvold, "Waste Utilization-Oxygen Delignification of Sulfite Knots", 1978, International Sulfite Conf. (9-1-3-78).

*Primary Examiner*—Steve Alvo

*Attorney, Agent, or Firm*—Biebel, French & Nauman

[57] ABSTRACT

Rejects such as knots, shives, slivers, chops, and uncooked and partially cooked wood chips are separated from a pulp slurry and treated to produce a bleachable grade pulp. The rejects are dewatered to a 10–15% consistency, mechanically fiberized, and then delignified at the same 10–15% consistency in the presence of oxygen and alkaline pulping chemicals. The delignification is carried out at 80°–140° C. for 5–120 minutes. The process has low external power requirements, requires no expensive dewatering machinery, and proceeds at a rapid rate to yield a bleachable grade pulp which can be used alone or mixed with other pulp.

9 Claims, 3 Drawing Figures

PROCESS FOR THE OXYGEN DELIGNIFICATION OF PULP MILL REJECTS

This is a continuation of application Ser. No. 072,796 filed Sept. 5, 1979, now abandoned.

BACKGROUND OF THE INVENTION

This invention relates to a process and apparatus for converting pulp mill screen rejects and/or knots into usable pulp, and more particularly to a process and apparatus for refining and oxygen delignifying pulp mill screen rejects and/or knots to produce a bleachable grade pulp.

Handling and disposal of screen rejects and knots from pulp mills have been a problem for many years. Screen rejects, or fine screen rejects as they are sometimes called, are coarse particles too large to pass through a fine screen of a given size. Screen rejects include shives, slivers, chops, and bark. Knots, or coarse screen or knotter rejects as they are sometimes called, are also oversized particles and include the knot part of the wood, partially cooked and uncooked good wood chips, large shives and fiber bundles too large to pass through a ¼ inch screen perforation.

For mills utilizing batch digesters, the knots and screen rejects can be recycled back into the digester and recooked. However, the resulting pulp is of low yield, and the rejects consume cooking chemicals and sometimes create channeling of pulping liquor within the digester. Moreover, the increasingly widespread use of continuous digesters has rendered recycle of the screen rejects impractical since they will eventually plug the liquor extraction screens used in continuous processes.

In pulp mills making unbleached grades of pulp, the screen rejects can be mechanically refined and be put back in the main pulp streams. However, in pulp mills making bleached grades of pulp, the screen rejects have often been heretofore unusable; these rejects must be removed from the process, dewatered, and then burned or hauled to a dump site. In the past, attempts at treatment by use of a separate bleaching step have not proved successful. In some cases in mills making unbleached grades, the knots have been mechanically refined and used in coarse grades of paper and board. However, such usage is very limited and may often not be economically viable. Traditionally, the knots are recooked in the digester. In some cases they are dewatered and dumped or burned.

Recently, however, processes have been reported in which screen rejects and knots have been delignified using oxygen to a bleachable level. Kirschner, Paper Trade Journal, p. 32 (Nov. 15, 1978), has reported the use of a low-consistency oxygen delignification process for draft and sulfite screen rejects which produces a bleachable grade of pulp. Hasvold, 1978 International Sulfite Conference, Montreal, Canada (Sept. 13, 1978), has reported an oxygen process which delignifies sulfite knots at a 25% pulp consistency.

However, both of these processes suffer from several disadvantages. Low-consistency operation requires a large reactor volume to maintain an acceptable retention time for the pulp. Operating at low consistency also produces large power demands for pumping large volumes of pulp and a high steam usage to heat the pulp in the reactor. Additionally, the low concentration of dissolved lignins in the pulp liquor increases evaporation costs for chemical recovery processes. Operation at 25% consistency, on the other hand, usually requires special dewatering equipment to attain the higher consistency. It is also known that high consistency operation of an oxygen delignification system can result in overheating of the pulp due to the exothermic delignification reaction, as well as pulp degradation, and even combustion of the pulp.

As can be seen, the need exists in the art for an efficient and economical process for utilizing pulp mill screen rejects and knots and converting them into bleachable grade pulp.

SUMMARY OF THE INVENTION

In accordance with the present invention, a process for oxygen delignifying pulp mill rejects either in the form of screen rejects or knots is provided. In one embodiment of the invention, pulp mill rejects, which may have about a 0.5–5.0% consistency, are dewatered to about a 10–15% consistency using a conventional dewatering device such as an inclined screw or vacuum-type thickener or a rotary drainer. The rejects stream is then sent at this 10–15% consistency to a mechanical fiberizing device such as a disc refiner or kneader.

The stream is then sent to an oxygen reactor device at the same 10–15% consistency with no further addition or removal of water. The oxygen reactor in which the delignification reaction occurs may be one or more vertically or horizontally oriented devices. Preferably, the reactor comprises a series of one or more tube reactors having rotary screws or paddles therein to ensure proper mixing of the pulp during delignification. Typically, the delignification is allowed to proceed for 5–120 minutes at a temperature of between 80° and 140° C., and preferably 10–30 minutes and at a temperature of 110° to 130° C. Various alkaline chemicals may be used for the delignification reaction. They include sodium hydroxide, sodium carbonate, ammonia, green liquor, and white or oxidized white liquor. A portion of the charge of alkaline chemical may be added directly at the fiberizing stage of the process. An overall oxygen pressure of 70–200 psig is maintained in the reactor during delignification.

The resultant pulp produced by the process of the present invention has a low Kappa number, a high yield, and high strength characteristics and is ready for further bleaching either alone or mixed with another pulp stream. The overall process is simple and economical requiring no expensive dewatering machinery, has a low steam consumption in the delignification reactor, and proceeds at a rapid delignification rate.

In another embodiment of the invention, knotter rejects and fine screen rejects may be mixed together prior to the fiberizing stage of the process. In this embodiment, knotter rejects from a deknotting device, which may have about a 0.6–2.0% consistency are processed through a centrifugal cleaner or like device where pieces of metal and rocks are removed. The knotter rejects are then sent to a series of one or more vibratory screens which serve to dewater the knots to about a 15–20% consistency, liberate any free fiber clinging to the knots, and wash away much of the black liquor from previous process stages which is on the knots.

The knots, at about 15–20% consistency, are then mixed with screen rejects having a consistency of about 0.5–5.0%. This mixture is then passed to a dewatering device such as an inclined screw thickener where the consistency of the mixture is raised to about 10–15%.

The mixture of knots and fine screen rejects is then mechanically refined followed by oxygen delignification.

In still another embodiment of the invention, knotter rejects alone are subjected to the above sequence of steps except that the knotter rejects may be passed directly to the refining stage of the process after thickening to a 10–15% consistency on a vibratory screen or other dewatering device.

Accordingly, it is an object of the present invention to provide a simple and economical process by which screen rejects and/or knotter rejects may be mechanically refined and oxygen delignified to produce a bleachable grade of pulp. This and other objects and advantages of the invention will become apparent from the following description, the accompanying drawings, and the appended claims.

DESCRIPTION OF THE PREFERRED EMBODIMENTS

After leaving the cooking or digestion stage of a typical soda, sulfite, or kraft process, the pulp is passed to a series of screens to remove oversized particles and impurities. Generally, the coarse screens or knotters are designated to remove knots, partially cooked or uncooked wood chips, and fiber bundles too large to pass through a ¼ inch screen perforation. These oversized particles are termed coarse screen rejects or knotter rejects. Fine screens, then, separate smaller objectionable particles such as shives, slivers, chop, and bark. For purposes of this invention, use of the term "rejects" will encompass both coarse screen as well as fine screen rejects.

Figure 1:
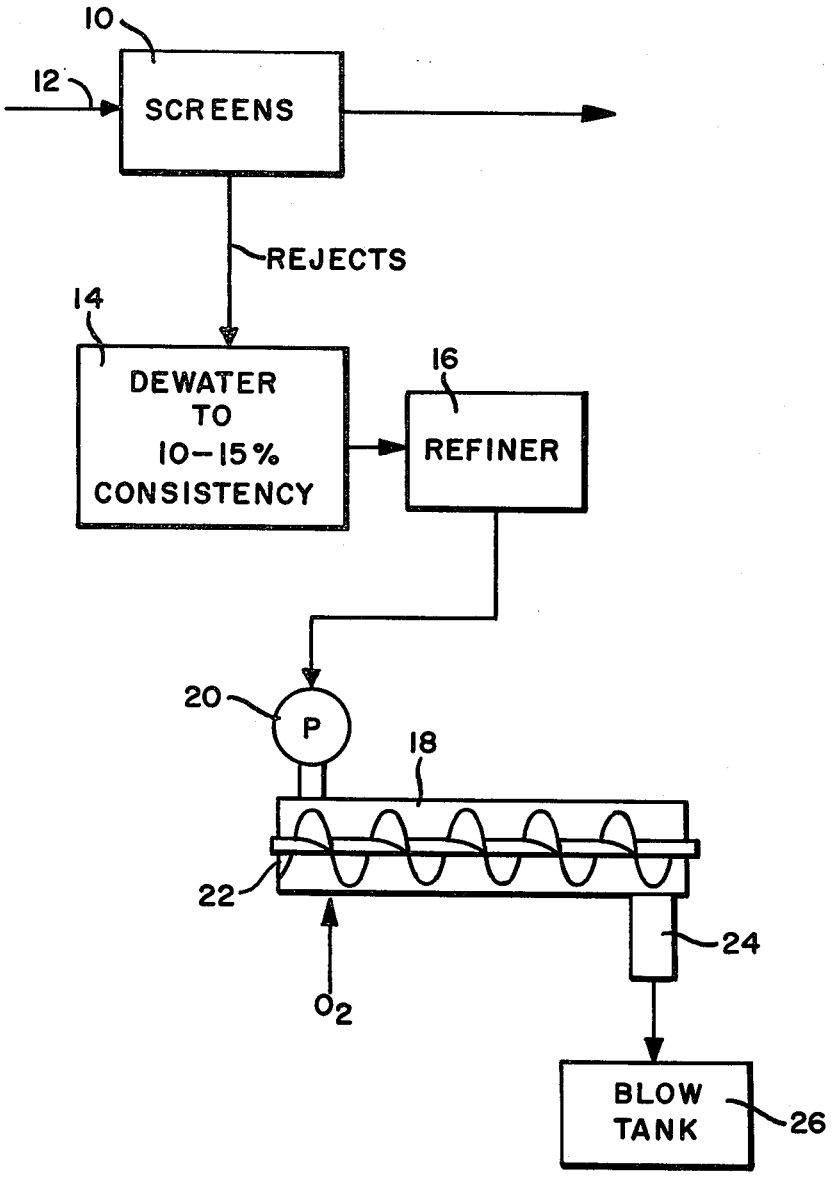
FIG. 1 is a simplified flow diagram illustrating one embodiment of the present invention.

As shown in FIG. 1, rejects from screens 10 are separated from the main pulp stream 12 and sent to dewatering station 14. The rejects may be either oversized particles from the coarse screens or particles separated out by the fine screens, or mixtures of both kinds of particles. Typically the consistency of the rejects steam will be about 0.5–5.0% when it leaves screens 10.

Dewatering station 14 comprises one or more standard dewatering devices used in the art. Preferably, an inclined screw thickener or a vacuum-type dewatering device or a rotary drainer is utilized to thicken the rejects streams to a consistency of between 10–15%. Because the process of the present invention thickens the rejects only to a 10–15% consistency, no special dewatering devices such as presses are required as would be required in processes which contemplate thickening to a 20–30% consistency.

The thickened rejects stream is then sent to a mechanical fiberizing device 16 such as a single or double disc refiner where it is refined at the same 10–15% consistency. The fiberizing device need not be pressurized and may operate at temperatures below 100° C. Some or all of the alkaline pulping chemical such as sodium hydroxide or sodium carbonate may be added directly to the throat of the refiner and evenly distributed throughout the rejects stream. In this manner, the 10–15% consistency slurry of material is lubricated and becomes easier to pump.

After fiberizing, the rejects stream at the same 10–15% consistency is sent to oxygen reactor 18 where it enters through valve or pump 20. Oxygen reactor 18, in which the delignification reaction occurs, may be one or more sealed vessels in series and may be either vertically or horizontally oriented. Preferably, the reactor comprises one or more tubular reaction vessels having at least one mixing device therein such as a bent or rotary flight screw indicated schematically as 22 in FIG. 1. Other mixing devices such as paddles could also be used. The presence of a mixing device in the reactor insures proper mixing of the slurry with oxygen and alkaline pulping chemicals during the delignification reaction. Typically, the delignification reaction is allowed to proceed for about 5–120 minutes, preferably 15–30 minutes, and at a temperature of between 80° and 140° C., preferably 110° to 130° C., although some variation in both time and temperature are contemplated depending upon the kind or kinds of wood being treated. The pulp is then discharged through outlet 24 to blow tank 26. From there, the pulp can be recombined with the main pulp stream.

Various alkaline pulping chemicals may be used for the delignification reaction. They include sodium hydroxide, sodium carbonate, green liquor, and kraft or oxidized white liquor. The alkaline pulping chemical may be added at the fiberizing stage of the process, as discussed above, although the addition of significant amounts of alkaline chemicals at that stage may result in low pulp yield and strength. Preferably, substantially all of the charge of alkaline chemical should be added to the first oxygen reactor vessel. A charge of from 5–15% by weight alkaline chemical to the slurry based on dry weight of fiber in the slurry has been found to be suitable. Some slight dilution of the consistency of the slurry is unavoidable when the charge of alkaline chemical is added.

Oxygen is added to the reaction vessel and maintained at a partial pressure of between 70 and 200 psig throughout the delignification reaction. At a consistency of 10–15%, steam requirements for the reactor vessel are quite low. Because of the exothermic nature of the reaction, it supplies a substantial fraction of the heat requirement. This presents significant advantages over prior low consistency reaction schemes which require high steam usage. It is also superior to high consistency reaction schemes in which so much heat is released by the delignification reaction that the pulp can be overheated and degraded or even combusted.

Figure 2:
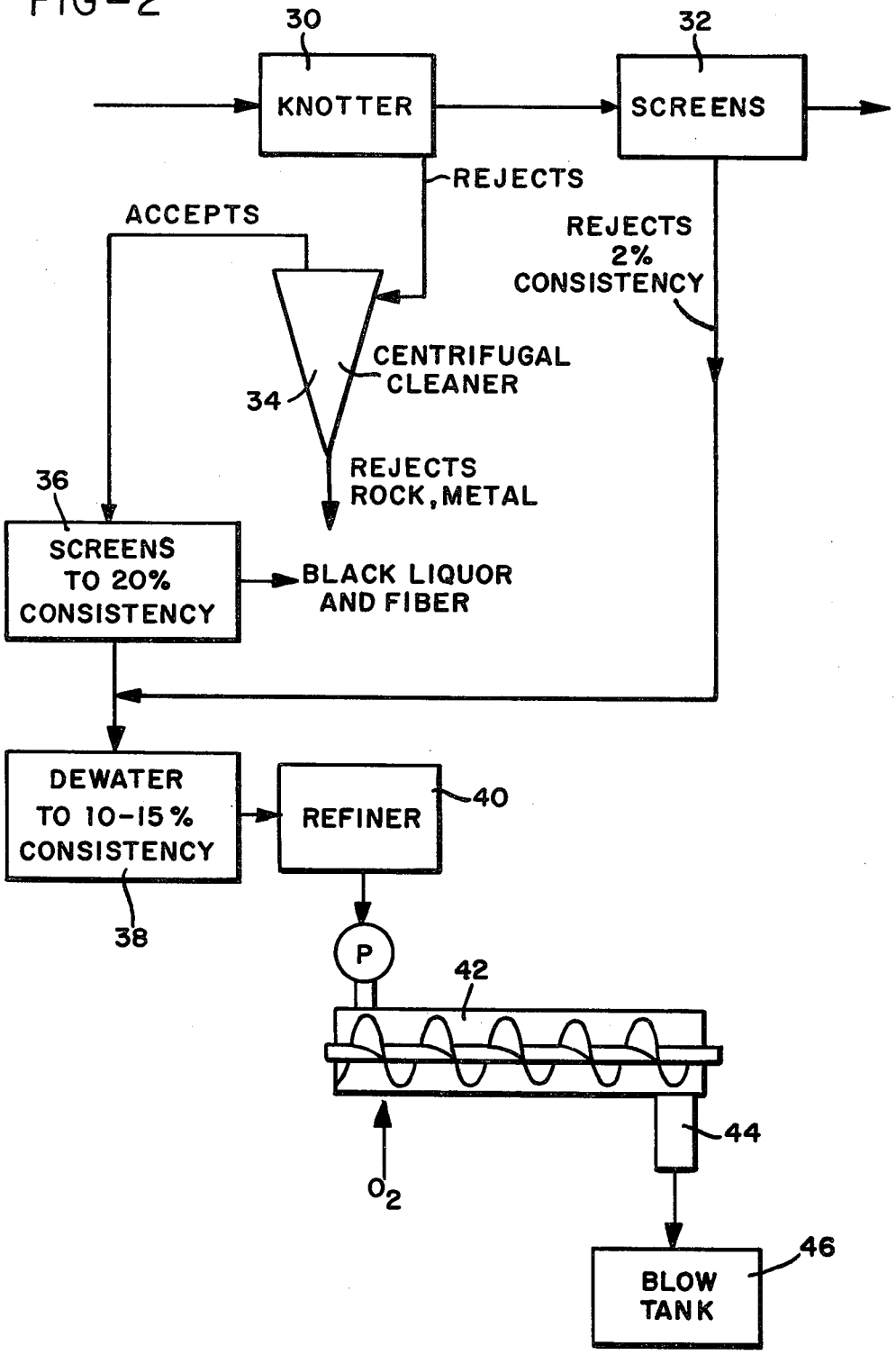
FIG. 2 is a simplified flow diagram illustrating another embodiment of the present invention.

Referring now to FIG. 2, an alternative embodiment of the invention is illustrated. In this embodiment, rejects from a knotter and fine screen are combined. A knotter 30, which may be of conventional design, removes knots from the main pulp stream. Accepts from the knotter are then passed to fine screens 32.

The rejects stream from knotter 30, typically at a 0.6 to 2.0% consistency, is preferably first sent to a cleaning device which may be a centrifugal cleaner or the like. Cleaner 34 removes heavy impurities such as pieces of metal and rocks which may be present in the knotter rejects stream and which, if allowed to remain, could damage machinery used in later stages of the process. The accepts stream from cleaner 34 is then sent to screens or drainers 36 where the stream is thickened to about a 20% consistency. Preferably, vibratory screens or rotary drainers are utilized. In this manner, much of the black liquor from a preceeding cooking or digestion stage clinging to the knots and other oversize particles is washed off during the thickening process and can be recovered for regeneration and reuse. Black liquor has a detrimental effect on the later oxygen delignification process and its removal at this stage of the process is desirable. Additionally, any free wood fiber clinging to the knots and oversize particles is removed during the thickening procedure and may be recycled back to the main pulp stream.

The knotter rejects stream at about 20% consistency is then mixed with a fine screen rejects stream typically having a consistency of about 0.5–5.0%. The mixture is passed to dewatering device 38 such as an inclined screw thickener where it is thickened to a 10–15% consistency. Fine screen rejects alone are somewhat difficult to dewater. However, when mixed with knots and other larger particles, the mixture is easily brought to a 10–15% consistency. This mixture is then fiberized in refiner 40 and delignified in reactor 42 at the same 10–15% consistency in the presence of oxygen and alkaline pulping chemicals as discussed above. After delignification, the pulp slurry is discharged from reactor 42 through outlet 44 into blow tank 46. From there it can be recombined with the main pulp stream.

Figure 3:
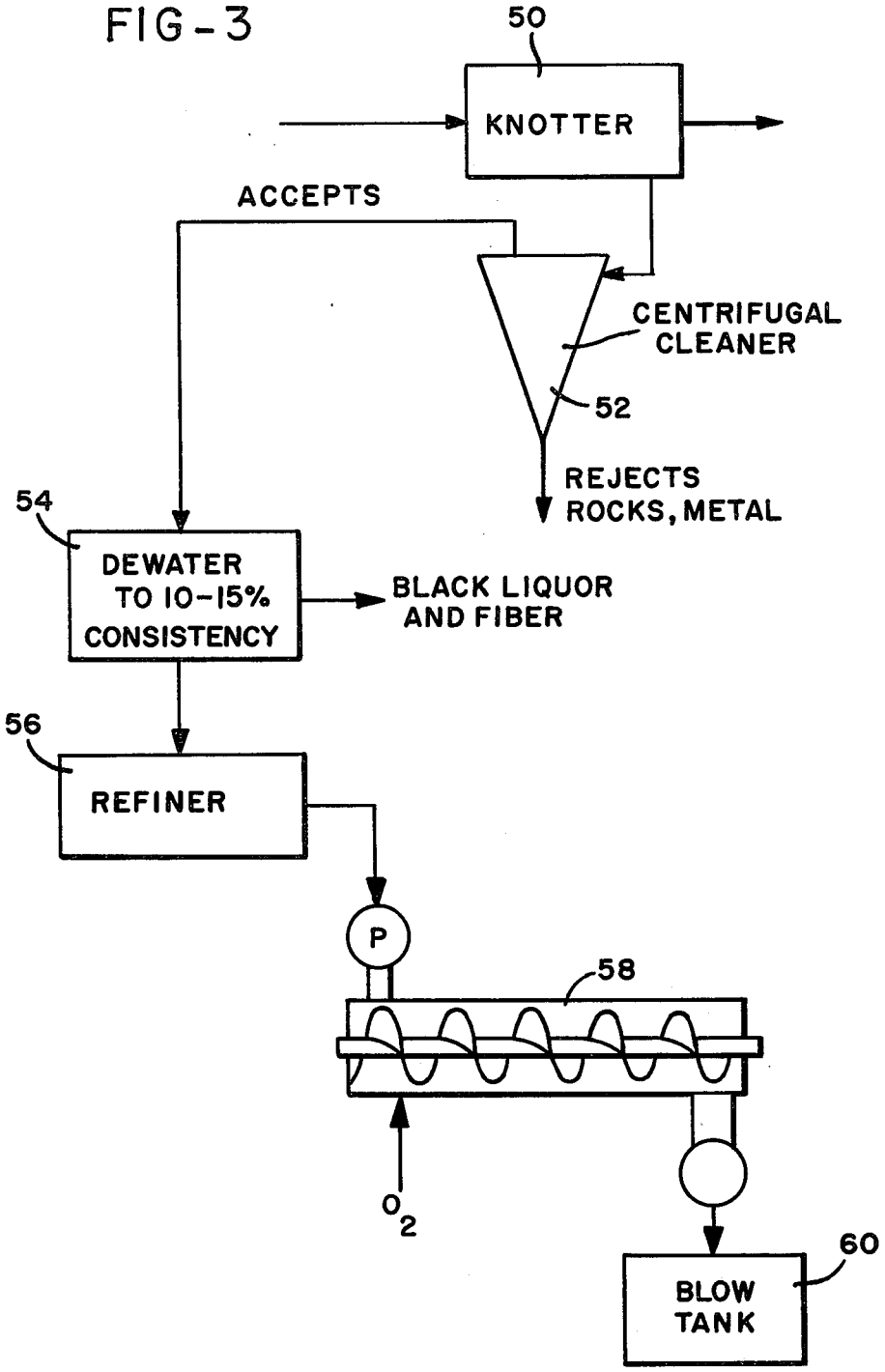
FIG. 3 is a simplified flow diagram illustrating yet another embodiment of the present invention.

Referring now to FIG. 3, in still another embodiment of the invention, knots and other oversize particles are separated from a pulp stream by knotter 50. The knotter rejects stream, typically at a 0.6–2.0% consistency, is passed to centrifugal cleaner 52 where any pieces of metal or rocks are removed. From there, the knotter rejects are taken to a dewatering device 54 which preferably is a vibratory screen where the stream is thickened to a 10–15% consistency. During dewatering, any black liquor or free fiber clinging to the knots or other oversize particles is washed off. The thickened stream at a 10–15% consistency is then fiberized in refiner 56 and delignified in reactor 58 in the presence of oxygen and alkaline pulping chemicals. The delignified pulp is discharged from reactor 58 into blow tank 60. From there the pulp can be recombined with the main pulp stream.

In order to better understand the process of the present invention, reference is made to the following nonlimitative examples.

EXAMPLE 1

Samples of secondary screen rejects from a kraft process consisting of equal amounts of southern hardwood and southern softwood rejects were refined in the 10–15% consistency range in a disc refiner and delignified with oxygen in a 2.0 $ft^3$ laboratory digester equipped with a low speed pulp mixing system of the type discussed above. The reaction conditions used in each run were as follows: sample size 2 lbs. OD (oven dry), 121° C., 150 psig total pressure, and 15% NaOH charge on OD pulp. Direct steam injection was used for heating the pulp, and the temperature was measured using a probe inserted in the pulp. The consistency of the pulp during the reaction was about 13%. No protector chemical (such as a magnesium compound) was used in any of the runs. The delignification results shown below in Table 1 were obtained using a starting pulp having a screened Kappa number of 90.

TABLE 1

Oxygen Delignification of Kraft Screen Rejects

| Retention Time (Minutes) | RPM | Kappa Number | Yield |
|---|---|---|---|
| 30 | 6 | 22.7 | 84.9 |
| 15 | 6 | 32.4 | — |
| 30 | 0 | 37.1 | — |

The results indicate that gentle agitation has a very significant effect on the rate of delignification. Furthermore, a final Kappa number close to 30 was obtained in a retention time of only 15 minutes. Short retention times are attractive from the viewpoint of minimizing the size and cost of commercial equipment for the process. Through precise measurement of reductions in pressure in the reactor during batch runs and by gas phase analysis, it was determined that for a Kappa reduction of 60 units, the oxygen consumption was 5.1% on OD feed pulp and the amount of carbon monoxide generated was 0.023% on OD feed.

EXAMPLE 2

As in Example 1, samples of secondary screen rejects from a kraft process where refined and delignified with oxygen at a 15% pulp consistency. The reaction was carried out under the following conditions: 9.0% sodium hydroxide charge based on oven dry wood, a total oxygen pressure of 105 psig, and a temperature of 100° C. for 30 minutes. The resulting pulp had a Kappa number of 46.0 and a yield of 88.6%.

EXAMPLE 3

Knotter rejects from a sulfite pulp stream were delignified in the presence of oxygen in accordance with the process of the present invention. The rejects stream having an initial Kappa number of 120 was thickened to a consistency of 15% on a standard vibratory screen and then refined in a mechanical fiberizer. The rejects were then delignified in a stirred reactor vessel for a period of 20 minutes at 120° C. Sodium hydroxide was added to the reactor in a dosage of 5% by weight of the dry wood content of the rejects stream. Oxygen was introduced into the reactor and maintained at 155 psig. The final Kappa number of the pulp was measured to be 32.7 with a yield of 78.9%. The final pH of the liquor was 8.5.

For comparison purposes, the prior art process of treating sulfite knotter rejects taught by Lea et al, U. S. Pat. No. 3,393,121, requires high temperatures (160°–180° C.), long cooking times (1.5–3.5 hours), and high alkaline chemical charges (15% by weight NaOH based on dry wood content) and results in pulp yields of less than 50%.

As can be seen, the process of the present invention provides a simple and economical process to recover bleachable grade pulp. No expensive dewatering machinery is required, there is a low steam and power requirement, and the delignification reaction proceeds rapidly.

While the methods herein described constitute preferred embodiments of the invention, it is to be understood that the invention is not limited to these precise methods, and that changes may be made without departing from the scope of the invention, which is defined in the appended claims.

What is claimed is:

1. A process for the treatment of pulp mill fine screen rejects and knotter rejects to produce a bleachable grade pulp comprising the steps of:

(a) treating a pulp stream from an initial cooking or digestion stage to separate knotter rejects from said pulp, (b) passing said pulp from step (a) to a fine screen to separate fine screen rejects, (c) dewatering said knotter rejects to a consistency of about 20% while removing black liquor and free fiber;

(d) mixing fine screen rejects from step (b) having a consistency of from about 0.5–5.0% with said knotter rejects;

(e) dewatering the mixture of knotter and fine screen rejects to a consistency of about 10–15%;

(f) mechanically fiberizing said mixture at the same 10–15% consistency;

(g) delignifying the fiberized mixture with mixing at the same 10–15% consistency in the presence of oxygen and alkaline chemicals for a period of from about 5 to about 120 minutes at 80°–140° C., in a reactor separate from any reactor used to delignify said pulp, and (h) sending said fiberized materials to a bleaching stage.

2. The process of claim 1 in which the delignification reaction is carried on for a period of from about 10 to about 30 minutes at 110°–130° C.

3. The process of claim 1 in which said alkaline pulping chemicals are selected from the group consisting of sodium hydroxide, sodium carbonate, ammonia green liquor, kraft white liquor, oxidized white liquor and mixtures thereof.

4. The process of claim 3 in which dewatering of said knotter rejects is accomplished on a vibratory screen.

5. The process of claim 3 in which dewatering of said knotter rejects is accomplished with a rotary drainer.

6. The process of claim 1 in which prior to step (c), said knotter rejects are subjected to centrifugal cleaning to remove rocks and metal.

7. The process of claim 6 in which part or all of the alkaline pulping chemical is added to said mixture during fiberizing step (f).

8. The process of claim 1 in which said delignification step is carried out in a horizontal tubular reactor.

9. The process of claim 8 in which said horizontal tubular reactor contains at least one mixing screw which is rotated to provide gentle agitation of said fiberized materials.

* * * * *